US005743754A

United States Patent [19]

Cristich

[11] Patent Number: 5,743,754

[45] Date of Patent: Apr. 28, 1998

[54] ELECTRICAL MULTI-PIN SNAP CONNECTOR

[76] Inventor: Cristi L. Cristich, 270 S. Old Bridge Rd., Anaheim Hills, Calif. 92808

[21] Appl. No.: 500,147

[22] Filed: Jul. 10, 1995

[51] Int. Cl.[6] ..... H01R 13/627

[52] U.S. Cl. ..... 439/349; 439/607

[58] Field of Search ..... 439/349, 345, 439/610, 108, 609, 95, 98, 607, 874, 876, 859

[56] References Cited

U.S. PATENT DOCUMENTS

| | | | |
|---|---|---|---|
| 2,314,751 | 3/1943 | Woodward | 439/846 |
| 2,404,176 | 7/1946 | Huelster | 439/846 |
| 2,677,811 | 5/1954 | Anderson et al. | 439/349 |
| 2,761,111 | 8/1956 | Klostermann | 439/349 |
| 3,995,644 | 12/1976 | Parsons | 607/116 |
| 4,072,386 | 2/1978 | Walls | 439/349 |
| 4,402,560 | 9/1983 | Swainbank | 439/37 |
| 4,762,497 | 8/1988 | Burvee | 439/37 |
| 5,004,425 | 4/1991 | Hee | 439/37 |
| 5,232,383 | 8/1993 | Barnick | 439/859 |
| 5,326,272 | 7/1994 | Harhen et al. | 439/86 |

*Primary Examiner*—Hien Vu

*Attorney, Agent, or Firm*—Gordon K. Anderson

[57] ABSTRACT

A multi-pin snap connector having a snap fastener stud (20) with a multi-conductor current carrying electrical plug (24) therein. The stud interfaces with a gripping ring snap fastener socket (42) which has a multi-conductor current carrying electrical socket (44) disposed within a hollow inside the fastener socket. The electrical socket and plug are reverse gender and have a density of 1,600 conductors per square inch (6.45 sq. cm), or a center to center spacing of 0.025 inch (0.635 mm). A spring (54 or 56) is held within the fastener socket and grips the stud when the pair are mated. The electrical socket and plug may be reversibly interchanged within the fastener stud and socket for specific applications.

22 Claims, 3 Drawing Sheets

ELECTRICAL MULTI-PIN SNAP CONNECTOR

TECHNICAL FIELD

The present invention relates to electrical connectors in general. More specifically to a multi-pin electrical connector using a spring loaded snap fastener for coupling attachment.

BACKGROUND ART

Previously, many types of coupling methods have been used in endeavoring to provide an effective means for producing a positive, yet easily removable method of attaching and releasing multi-pin electrical connectors. The most common method is to utilize only the spring characteristics of the female connector, specifically a pair of female leaf spring sockets into which a solid male blade is inserted, correlative with household receptacles and appliance plugs.

In the field of electronics more positive methods have been adapted, such as coupling nuts that incorporate threads on a barrel and a captive fully threaded nut to draw the plug and socket together in a positive and forceful manner. Other round connectors utilize a nut that engages and locks with a quarter to a full turn. Spring loaded mechanisms have also been in use where the halves are pushed together and rotated with the spring holding them in contact in a bayonet like connection. Other spring devices attach the connectors by pushing together to mate and then again pushing further to release the latch allowing separation.

In the discipline where very small connectors are required, known in the industry by the designation mini, micro, and nano, different types of jackscrews, jackposts, outer latching devices, as well as a variety of coupling nuts, are utilized. The instant invention is directed to this latter size restraint with a unique combination utilizing a snap fastener approach to connect and retain connector halves, and yet permit easy detachment.

A search of the prior art did not disclose any patents that read directly on the claims of the instant invention, however, the following U.S. patents are considered related:

| U.S. Pat. No. | Inventor | Issue Date |
|---|---|---|
| 5,326,272 | Harhen et al | Jul. 5, 1994 |
| 5,232,383 | Barnick | Aug. 3, 1993 |
| 5,004,425 | Hee | Apr. 2, 1991 |
| 4,762,497 | Burvee | Aug. 9, 1988 |
| 4,402,560 | Swainbank | Sep. 6, 1983 |
| 3,995,644 | Parsons | Dec. 7, 1976 |
| 2,404,176 | Huelster | Jul. 16, 1946 |
| 2,314,751 | Woodward | Mar. 23, 1943 |

Harken et al in U.S. Pat. No. 5,326,272 teaches a low profile connector with a conductive body configured to interface with a bio-medical TEUS electrode.

U.S. Pat. No. 5,232,383, issued to Barnick, is for a single conductor connector having several flexible fingers that mate into a male ball stud. The fingers are sufficiently resilient to maintain contact while a pad electrically embraces the stud.

Hee's U.S. Pat. No. 5,004,425 discloses a magnetic connection assembly for a ground cord similar to a snap fastener, but not utilizing frictional or spring loaded snaps.

U.S. Pat. No. 4,762,492 of Burvee is for a single conductor static electricity flowpath connector that is connected through fabric. A pair of studs transmit the electrical flow, and a reservoir filled with electrically conductive gel permits contact through fabric.

Swainbank in U.S. Pat. No. 4,402,460 presents a wrist strap with the male end of a snap connector and a housing to receive the female end. The snap connector provides the current flowpath for conducting static electricity.

U.S. Pat. No. 3,995,644 of Parsons directs his invention to a percutaneous connector implanted through the skin of a patient. One embodiment utilizes a horseshoe shaped spring that is positioned on the side of a stud acting as a conductor with another similar spring interfacing with a second post for conducting electrical signals therethrough.

Huelster's U.S. Pat. No. 2,404,176 uses a conventional socket and stud with a contact member upset against spring fingers for engaging the stud when assembled.

Likewise, Woodward's U.S. Pat. No. 2,314,751 patent discloses a stud and socket member with elongated metal strips, with ears, to engage electrical wire.

It will be noted that the use of a snap fastener for a single conductor electrical connector has been known for over a half century, however, the fact that the normal material of construction is an electrical conductor and its ability to assemble and disassemble easily has restricted those skilled in the art to a single conductor device primarily used for grounding.

DISCLOSURE OF THE INVENTION

One of the problems with miniature connectors, particularly one of the smallest so-called Nano series, with a contact spacing of 0.025 inch (0.635 mm), are the mechanisms utilized to engage and keep engaged the connectors themselves. While conventional methods, such as previously discussed, have been in common usage, specific problems have arisen due to their diminutive size. Jackscrews may be as small as #1–64 UNC or even #0–80 UNF, which may be easily lost or the threads stripped. Jackposts require small nuts subject to the same difficulties. Latches using a female box on one half of the connector and a U-shaped leaf spring on the other are of necessity, minute, and fragile. Threaded coupling nuts are also subject to the same problems, particularly in the areas of threads which may be easily misthreaded and stripped.

It is, therefore, a primary object of the invention to utilize a snap fastener that has a preformed stud with inwardly formed neck and a spring loaded socket that slips over the stud and locks in place. This fastening method permits the connector halves to be embedded inside the snap fastener pieces and by simply engaging the connector and pushing the parts together, the connector is seated and constant spring tension holds the connector together until it is manually disconnected.

An important object of the invention is directed to the simplicity of the operation, as no tools are required to turn threaded fasteners or rotate circumferential nuts. Actually, as no threads are used anywhere the problem of stripping, seizing, or breaking is completely eliminated.

Another object of the invention is the ability of the connector to be grounded through the shell. As both halves of the snap fastener may be fabricated of an electrical conductor, such as metal, a ground flowpath is continually in existence between the halves when the connector is mated. This feature eliminates the requirement for an additional contact in the connector.

Still another object of the invention is the application with a snap fastener which allows the use of reverse gender contacts, as the connector does not interfere with the connector in its functional adaptation. Further, either element of the connector, the plug or electrical socket, may be used within the snap fastener stud or socket with equal ease.

Yet another object of the invention permits the most commonly used terminations to be employed with no difficulty, including discrete wires, crimped, soldered, welded, chemically, or electrically bonded, etc. Extended pins may penetrate holes in printed circuit boards, or wires may be flared out and then soldered onto pads on printed circuit boards or printed flexible substrate. In each case, the snap pin or socket does not interfere with the termination.

A final object of the invention lends itself to both electromagnetic interference (EMI) prevention and applications where this is not a consideration. For EMI prevention, the metallic shield may be easily attached to a metallic enclosure over the snap fastener socket and the other end to the snap stud itself continuing the shield completely through the connector with a conductive metallic barrier.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment.

Figure 1:
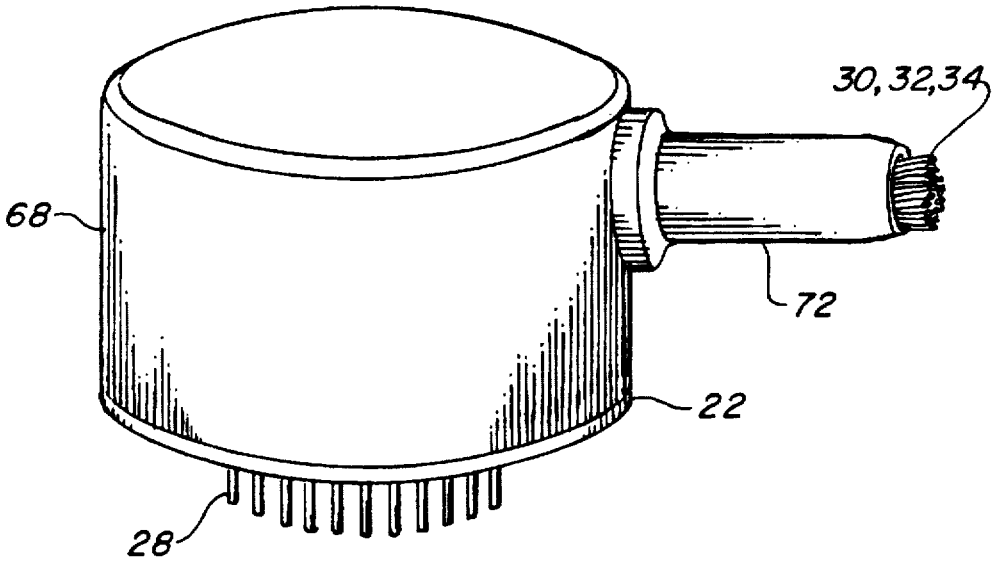
FIG. 1 is a partial isometric view of the preferred embodiment.
Figure 4:
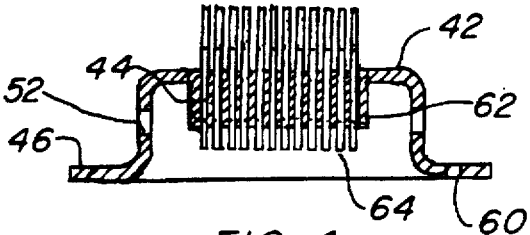
FIG. 4 is a cross-sectional view of the snap fastener socket and electrical socket taken along the centerline, completely removed from the invention for clarity.
Figure 2:
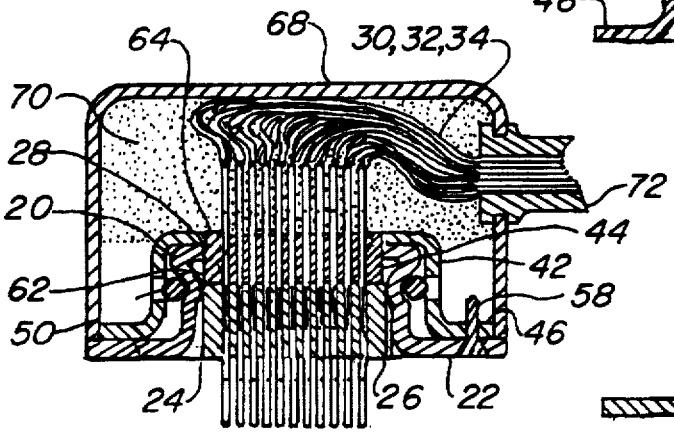
FIG. 2 is a cross-sectional view of FIG. 1.
Figure 5:
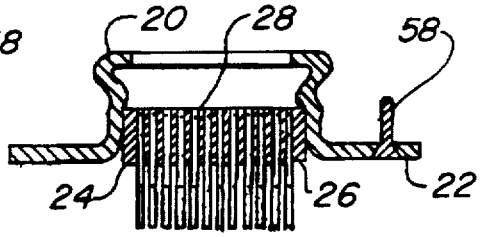
FIG. 5 is a cross-sectional view of the snap fastener stud and electrical plug taken along the centerline, completely removed from the invention for clarity.

The preferred embodiment, as shown in FIGS. 1 through 19, is comprised of a snap fastener stud 20, as shown in FIGS. 2 and 5. This stud 20 is round and contains a flange 22 on the bottom portion. The raised top surface is similar in diameter with the flange 22 and tapers inwardly, either straight or with a slight inwardly formed radius, as illustrated. FIGS. 5 depicts the shape best with the stud 20 further having a hole directly in the top making the configuration much like a hollow flanged ring. The stud is made of preferably a metallic material, such as brass, copper, steel, aluminum, or the like, or may even be molded structural thermoplastic. Plating with cadmium, nickel, tin, etc., is preferred in the metallic embodiment.

A multi-conductor current carrying electrical mating connector, preferably in the form of a plug 24, is positioned within the hollow and held in place by compression or bonded with epoxy, or the like. It is even anticipated that the thermoplastic embodiment may have the stud molded integrally with the electrical plug 24. At any rate, the electrical plug 24, shown in the cross-section of FIG. 5, includes a plug insulator 26 of a thermoplastic material either phenolic or polyester, such as polyphenylene sulphide, or polythalamide plastic with a liquid crystal polymer known by its tradename VECTRA or RYTON, preferred.

Figure 9:
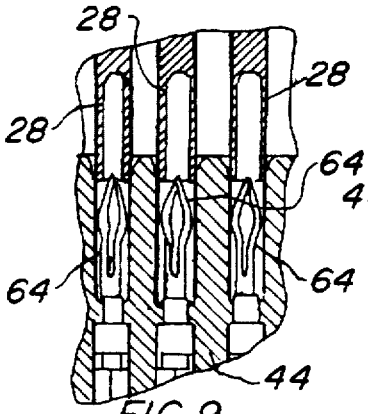
FIG. 9 is a fragmentary cross-sectional view of the reverse gender electrical plugs and sockets partially disengaged.

The plug 24 further is preferably the reverse gender type having a plurality of spring member male contacts 28 recessed in the socket insulator 26. They are designated reverse gender, as each male contact 28 is recessed below the mating surface of the insulator 26, as depicted in FIG. 5. FIG. 9 further illustrates a number of male spring contacts 28 and their relationship within the insulator 26.

Figures 6, 7, 8:
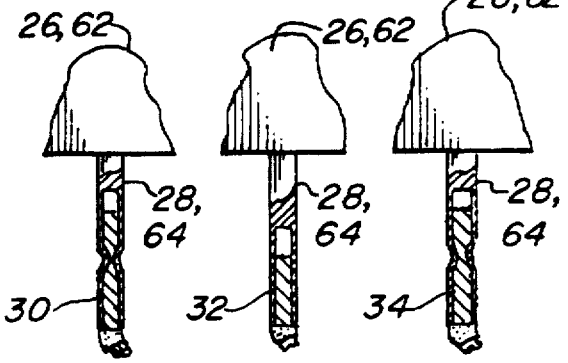
FIG. 6 is a fragmentary cut-away view of the socket and plug terminating means in the crimped configuration.
FIG. 7 is a fragmentary cut-away view of the socket and plug terminating means in the soldered configuration.
FIG. 8 is a fragmentary cut-away view of the socket and plug terminating means in the welded configuration.
Figure 16:
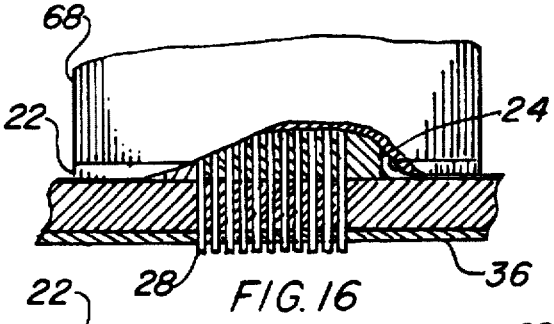
FIG. 16 is a partially cut-away fragmentary view of the connector with the plug terminating means soldered into a printed circuit board.
Figure 18:
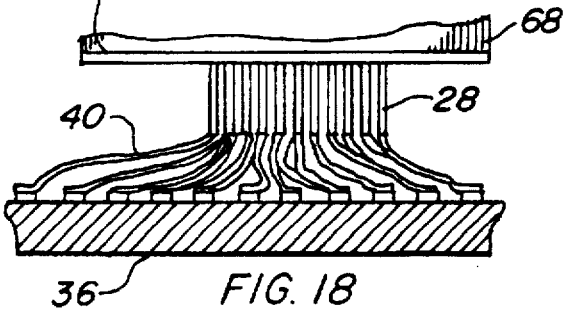
FIG. 18 is an elevation view of the connector with plug terminating means configured with discrete wires flared out and soldered to a printed circuit board.
Figure 19:
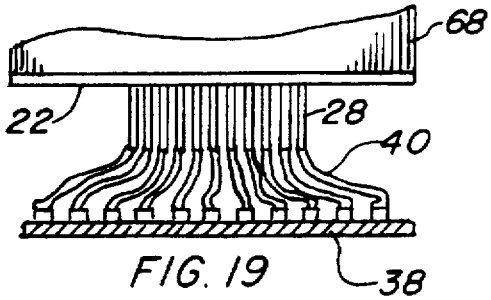
FIG. 19 is an elevation view of the connector with plug terminating means configured with discrete wires flared out and soldered to a printed flexible substrate.

The opposed end of each male contact 28 includes plug terminating means for concluding an electrical flowpath from the connector. The terminating means for the plug 24 include, but are not limited to the following;

- a plurality of crimped discrete wires 30, as illustrated in FIG. 6. This method is accomplished by inserting the wire 30 into a hollow opposite end of the male contact 28 and upsetting the metal or crushing it into the wire 30,
- a plurality of soldered discrete wires 32, as illustrated in FIG. 7. This method is accomplished by inserting the wire 32 into a solder cup on an opposite end of the male contact 28 and heating and introducing a composition of tin and lead having a lower melting temperature than the wire 32 and contact 28, which fills the gap therebetween when in liquidous condition by capillary action,
- a plurality of welded discrete wires 34, as illustrated in FIG. 8. This method involves inserting the wire 34 into a hollow opposite end of the male contact 28 crimping and applying a direct electrical current that heats and fuses the material together, best known in the industry as resistance welding, a printed circuit board 36, as illustrated in FIG. 16. The connector may be positioned directly onto a printed circuit board 36 with the opposite ends of the male contact 28 penetrating holes in the board 36 and soldered to the board conductive substrate in a conventional manner, a flexible printed circuit 38 is illustrated in FIG. 16. Wire leads 40 may be connected to the male contact 28, as described above, and then flared out and soldered to pads on the printed flexible circuit, finally, FIG. 18 illustrates a further method that uses the same discrete wire 30, 32 or 34 flared and attached to pads on the reverse side of the printed circuit board 36.

Figure 12:
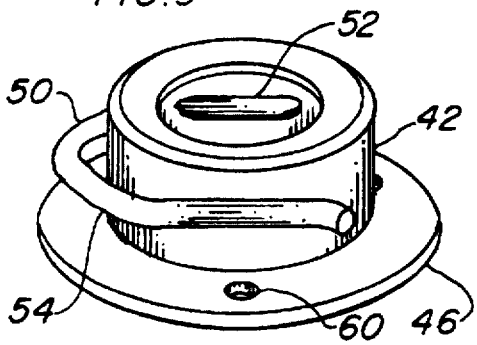
FIG. 12 is a partial isometric view of the snap socket with hairpin spring completely removed from the invention for clarity.

The connector further includes a gripping ring snap fastener socket 42, that mates with the stud 20 and incorporates a multi-conductor current carrying electrical mating connector, preferably in the form of a socket 44, as illustrated in FIGS. 2 and 4. The fastener socket 42, like the stud 20, contains an outwardly extending flange 46 on the bottom portion and the inside diameter is only slightly larger than the outside diameter of the stud 20 permitting a clearance fit therebetween. The top portion contains a hole making it also a hollow flanged ring. The sides may be straight, as shown in FIGS. 12 and 14, or have a cavity 48 extending outwardly from the inside diameter illustrated in FIGS. 13 and 15.

The gripping ring may be of any configuration known in the art, however, one of two embodiments are preferred. The first ring embodiment is illustrated in FIGS. 2, 4, 11, 14 and 17 and consists of a pair of opposed slots 52 in the upstanding cylindrical portion of the sidewalls of the fastener socket 42. A hairpin spring 54 is placed around the socket 42 penetrating both slots 52. The sides of the hairpin spring 54 are actually inside the socket 42 itself. When the fastener socket 42 is placed over the stud 20 and urged downwardly by exerting pressure, the spring 54 retracts permitting entry of the stud 20 and grips tightly when the stud 20 and fastener socket 42 are fully engaged returning to its normal shape.

Figure 13:
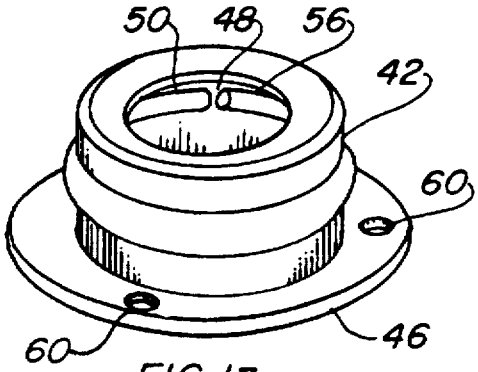
FIG. 13 is a partial isometric view of the snap socket with round spring completely removed from the invention for clarity.
Figure 14:
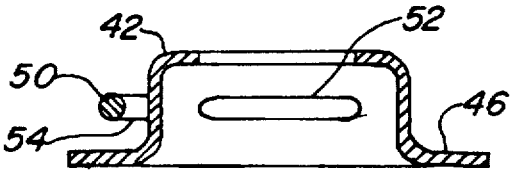
FIG. 14 is a cross-sectional view of FIG. 12.
Figure 15:
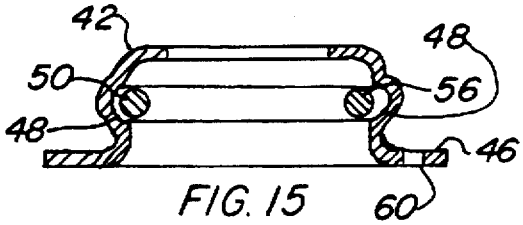
FIG. 15 is a cross-sectional view of FIG. 13.

The second ring embodiment is depicted in FIGS. 13 and 14 and consists of the cavity 48 in the fastener socket 42 sidewall. A round spring 56 is positioned within the cavity 48 and when the fastener socket 42 is urged over the stud 20, the spring 56 expands for entry and then grips tightly when the stud 20 and fastener socket 42 are fully engaged, as the spring 56 returns to its normal shape.

The snap fastener socket 42 is preferably made of metal, such as a plated material the same as previously described for the stud 20. The stud 20 and socket 42 must mate in exactly the same orientation in order to have the multi-conductors interface in the appropriate relationship. Indexing means integral with the connector permit this proper positioning. There are many methods well known in the art, such as indexing pins in either the electrical socket or plug that mate with holes in the opposite element. Grooves and raised bosses in the diameters of the connectors are commonly used. Irregular pin spacing, or different size pins and sockets prevent mismatch, further asymmetrical shapes also achieve this purpose. Any of the above indexing means along with a myriad of well known unmentioned approaches are acceptable for use with the instant invention. The preferred embodiment, however, utilizes three guide posts 58 attached to the stud 20 and mating guide holes 60 in the flange 46 of the fastener socket 42. FIGS. 4 and 5 illustrate this relationship and FIG. 2 shows them mated. It should be noted that a single post 58 and hole 60 is also an acceptable alternate.

The electrical socket 44 is positioned within the hollow of the fastener socket 42 and held in place by compression or bonded with epoxy, or the like. The electrical socket 44 is shown by itself in FIG. 10 and in cross-section in FIG. 4, and includes a socket insulator 62 of the same basic construction and material as the plug insulator 26, previously described.

The socket 44 is also the reverse gender type having a plurality of extended socket hollow fixed diameter tubular female contacts 64 embedded within the insulator 62 of the socket 44. FIG. 9 illustrates this configuration with the female contacts 64 protruding above the insulator 62 and the male contacts 28 partially entering the plug. It will be seen that when the plug male contacts 28 mate with the female contacts 64, the spring members retract and maintain a spring loaded union for an optimum resistance to the flow of electricity between the contacts.

Figure 10:
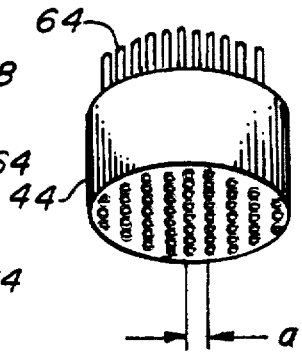
FIG. 10 is a partial isometric view of the electrical socket, completely removed from the invention for clarity, showing the pin density by the letter "a".

The electrical plug 24 and electrical socket 44 of the snap connector preferably have a pin density of 1,600 conductors per square inch (6.45 sq. cm) or less. This pin density equates to a 0.025 inch (0.635 mm) center to center conductor spacing, as illustrated in FIG. 10 by the letter "a", which is designated by the industry a Nano type (connector). The invention, however, may be applied to a larger or smaller pin spacing with equal ease. In any event, it is preferred to have the male and female contacts 28 and 64 of the Nano size, even though the spacing may be different or combined with other larger or non-standard spacing.

Figure 17:
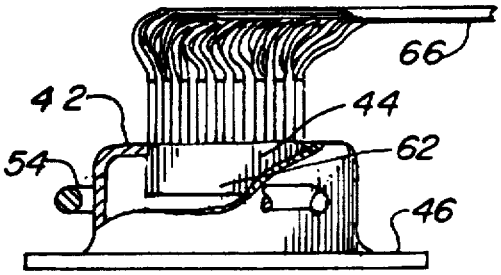
FIG. 17 is a cut-away cross-sectional view of the snap fastener socket and a combined elevational view of the electrical socket showing the socket terminating means in a flat ribbon cable.

The opposed end of each female contact 64 includes socket terminating means for establishing an electrical flow-path into the connector. The terminating means for the female contacts 64 are basically the same as previously described for the male contacts 28, in the crimped discrete wires 30, soldered discrete wires 32, and welded discrete wires 34, shown in FIGS. 6 through 8. A flat ribbon cable 66, as illustrated in FIG. 17, is also an exceptable terminating means for the electrical socket 44. The ribbon cable may have the leads separated and individual wires connected to the female contacts, as above.

The discrete wires or separated cable of both the electrical plug 24 and socket 44 terminating means may be 24 AWG (American Wire Gauge) size or 30 AWG, with 30 AWG preferred in the Nano style connector.

Figure 3:
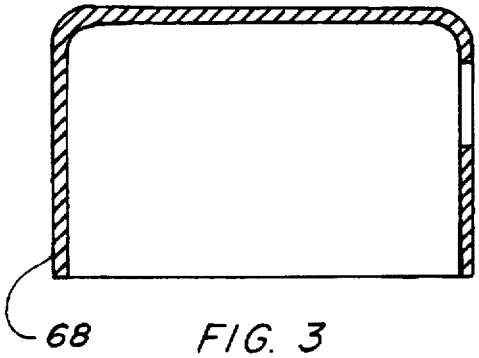
FIG. 3 is a cross-sectional view of the enclosure taken along the centerline, completely removed from the invention for clarity.

An enclosure 68, as shown in FIGS. 1, 2 and by itself in FIG. 3, is attached to the flange 46 of the fastener socket 42. This enclosure 68 encases the socket 44 and fastener socket 42 for protection of the terminating means and provides a convenient receptacle for applying potting material 70, such as epoxy, inside to hermetically seal the terminating wires, holding them rigidly in place and also protecting the connector from wicking. The enclosure 68 may be any material suitable for the purpose, such as metal, thermoplastic, cardboard, and the like. For structural purposes, to hold the wires or cable where leaving the enclosure 68, a cable retainer 72, as shown in FIGS. 1 and 2, may be incorporated. This retainer 72 may be a simple hollow extension, as shown, or may include clamps or grips well known in the art for holding individual or sheathed wires leaving a connector.

Figure 11:
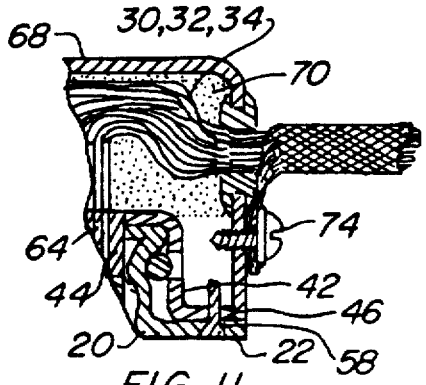
FIG. 11 is a fragmentary cross-sectional view of the electromagnetic shield fastener on the enclosure.

The connector may include an electromagnetic interference shield integral with the connector. This shield includes a metallic enclosure 68 and fastener socket 42 mechanically bonded together to contain any electromagnetic fields that may be present in the wires or cables, as the flowpath continues through the connector. An electromagnetic interference shield fastener 74 is added to the enclosure 68, as shown in FIG. 11, providing termination of the metallic flexible shield surrounding the cable or wire bundle attached to the connector. The same type of shield fastener 74 is included in the wire or cable leaving the connector dependant on the type of connection to the snap stud, as an example, printed circuit boards, and the like. If the connector is in line, a similar enclosure 68 would be added to the underside of the stud 20 using a similar fastener 74.

Figure 20:
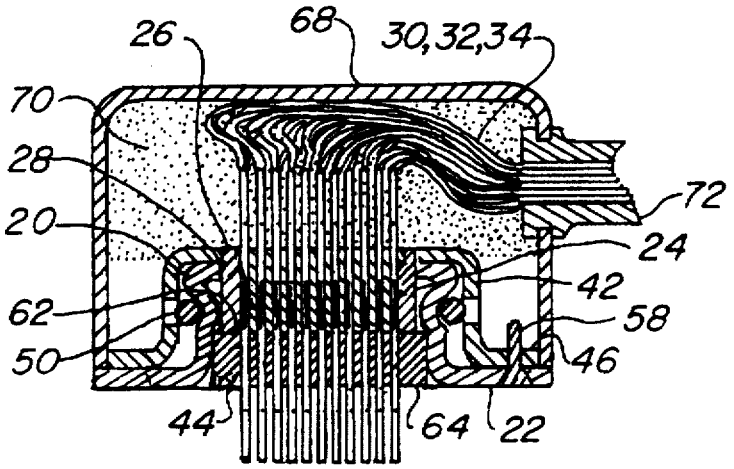
FIG. 20 is a cross-sectional view of FIG. 1, except the first mating connector comprises a plug and the second mating connector comprises a socket.

It may be noted that the preferred embodiment, as shown in the drawings and previously described, utilizes a mating electrical connector in the form of an electrical plug 24 in the fastener stud 20 and the electrical socket 44 in the fastener socket 42. This arrangement may be easily reversed for specific applications by employing the electrical socket 44 in the stud 20 and the electrical plug 24 in the socket 42 as depicted in FIG. 20. Function, shielding and terminating means remain unchanged, only the mechanical interface is reversed.

In operation, electrical connections are made to the electrical plug 24 and electrical socket 44 and the fastener socket 42 is placed over the fastener stud 20 and oriented with the guide holes 60 slipping over the guide pins aligning the male contacts 28 with the female contacts 64. When the enclosure 68 is pushed into the stud 20, the spring 54 or 56 expands and the fastener snaps into intimate contact. The spring holds the connector together by spring tension until it is pulled apart, lifting on the enclosure 68 or cable retainer 72 until it separates. Other handles, protrusions, rings, or the like, may be added to the enclosure 68 or flange 22, 46 according to the application.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. An electrical multi-pin snap connector comprising:

a snap fastener stud having a multi-conductor current carrying first electrical mating connector disposed therewithin, a gripping ring snap fastener socket, compliant with the snap fastener stud, having a multi-conductor current carrying second electrical mating connector disposed within the snap fastener socket, the second electrical mating connector insertably conforming with the first electrical mating connector such that when the stud and snap fastener socket are urgingly snapped together, the electrical mating connectors interconnect creating a flowpath for electricity and the stud and snap fastener socket provide a spring retention means for the mating connectors in a removable manner, said first electrical mating connector and second electrical mating connector are reverse gender with an electrical socket having a plurality of extended hollow fixed diameter tubular female contacts and a plug having a plurality of spring member male contacts recessed within the plug for mating insertion into the electrical socket, and an electromagnetic interference shield of a metallic composition completely enclosing the snap fastener socket and a portion of the snap fastener stud.

2. The snap connector as recited in claim 1 wherein said first mating electrical connector comprises an electrical plug and said second mating electrical connector comprises an electrical socket.

3. The snap connector as recited in claim 1 wherein said first mating electrical connector comprises an electrical socket and said second mating electrical connector comprises an electrical plug.

4. The snap connector as recited in claim 1 wherein said electrical mating connectors further comprise a pin density of no more than 1,600 conductors per square inch (6.45 sq. cm), which equates to 0.025 inch (0.635 mm) center to center conductor spacing.

5. The snap connector as recited in claim 4 wherein said plug terminating means further comprise a flexible printed circuit attached by solder.

6. The snap connector as recited in claim 4 wherein said spring retaining ring further comprises;

said snap fastener socket having a pair of slots, one slot opposite the other slot on an upstanding cylindrical portion, and a hairpin spring surrounding said fastener socket penetrating both slots such that when the fastener socket is urged over the pin, the hairpin spring retracts for entry and grips tightly when the stud and fastener socket are fully engaged.

7. The snap connector as recited in claim 4 wherein said spring retainer ring further comprises;

said snap fastener socket having a cavity formed in an upstanding cylindrical portion, and a round spring disposed within the cavity such that when the fastener socket is urged over the stud, the round spring expands for entry and grips tightly when the stud and fastener socket are fully engaged.

8. The snap connector as recited in claim 4 wherein said electrical socket terminating means further comprise a plurality of crimped discrete wires.

9. The snap connector as recited in claim 4 wherein said electrical socket terminating means further comprise a plurality of soldered discrete wires.

10. The snap connector as recited in claim 4 wherein said electrical socket terminating means further comprise a plurality of welded discrete wires.

11. An electrical multi-pin snap connector comprising:

a snap fastener stud, having a multi-conductor current carrying electrical plug disposed therewithin, plug terminating means connected to said plug for concluding an electrical flowpath from the connector, a snap fastener socket compliant with the snap fastener stud, having a multi-conductor current carrying electrical socket insertably conforming with the electrical plug disposed within the snap fastener socket, socket terminating means connected to said socket for establishing an electrical flowpath into the connector, a spring retaining ring in intimate contact with the snap fastener socket such that when the stud and snap fastener socket are urged together the electrical plug and socket interconnect creating a flowpath for electrical currents and the stud and snap fastener socket mate together with the retaining ring grasping the stud to provide retention for the connector in a removable manner, indexing pin means integral with the snap fastener stud for positioning the electrical plug and socket such that relevant conductors mate, and an enclosure contiguous with the snap fastener socket for encasing the plug and snap fastener socket.

12. The snap connector as recited in claim 11 wherein said electrical plug and electrical socket are reverse gender with the socket having a plurality of extended hollow fixed diameter tubular female contacts and the plug having a plurality of spring member male contacts recessed within the plug for mating insertion into the socket.

13. The snap connector as recited in claim 11 wherein said electrical socket and electrical plug further comprise a pin density of no more than 1,600 conductors per square inch (6.45 sq. cm), which equates to 0.025 inch (0.635 mm) center to center conductor spacing.

14. The snap connector as recited in claim 11 wherein said plug terminating means further comprise a plurality of crimped discrete wires.

15. The snap connector as recited in claim 11 wherein said plug terminating means further comprise a plurality of soldered discrete wires.

16. The snap connector as recited in claim 11 wherein said plug terminating means further comprise a plurality of welded wires.

17. The snap connector as recited in claim 11 wherein said plug terminating means further comprise a printed circuit board attached by solder.

18. The snap connector as recited in claim 11 wherein said indexing means further comprise at least one guide post within said stud and said fastener socket having at least one guide hole with the post penetrating the hole when the connector is mated.

19. The snap connector as recited in claim 11 further comprising potting material inside the enclosure to hermetically seal the plug terminating means and protect the connector from wicking.

20. The snap connector as recited in claim 11 further comprising an electromagnetic interference shield fastener integral with said enclosure for connecting a shield thereunto.

21. The snap connector as recited in claim 11 wherein said socket and plug terminating means further comprise 24 AWG wire.

22. The snap connector as recited in claim 11 wherein said socket and plug terminating means further comprise 30 AWG wire.

* * * * *